US007047700B2

(12) United States Patent
Dodson et al.

(10) Patent No.: US 7,047,700 B2
(45) Date of Patent: May 23, 2006

(54) PANEL FORMING SYSTEM AND COMPONENTS

(75) Inventors: Gordon Dodson, Lewis Center, OH (US); Kyozaburo Takagi, Centerville, OH (US)

(73) Assignee: Fukuvi USA, Inc., Huber Heights, OH (US)

( * ) Notice: Subject to any disclaimer, the term of this patent is extended or adjusted under 35 U.S.C. 154(b) by 0 days.

(21) Appl. No.: 10/325,451

(22) Filed: Dec. 20, 2002

(65) Prior Publication Data

US 2003/0115816 A1 Jun. 26, 2003

Related U.S. Application Data

(60) Provisional application No. 60/344,835, filed on Dec. 21, 2001.

(51) Int. Cl.
*E04B 1/16* (2006.01)

(52) U.S. Cl. ..... 52/381; 249/188; 403/21; 403/388

(58) Field of Classification Search ..... 52/381; 249/188, 189; 256/65.14; 403/21, 387, 403/388

See application file for complete search history.

(56) References Cited

U.S. PATENT DOCUMENTS

| | | | | | |
|---|---|---|---|---|---|
| 640,075 | A * | 12/1899 | Arnold | 404/3 |
| 3,561,801 | A * | 2/1971 | Chiu | 403/264 |
| 4,025,209 | A * | 5/1977 | Vollenweider | 403/189 |
| 4,042,205 | A * | 8/1977 | Herrell | 249/189 |
| 5,271,687 | A * | 12/1993 | Holka et al. | 403/233 |
| 6,279,868 | B1 * | 8/2001 | Eyring et al. | 249/177 |
| 6,736,366 | B1 * | 5/2004 | Eyring et al. | 249/177 |
| 6,840,018 | B1 * | 1/2005 | Takagi | 52/600 |
| 6,883,772 | B1 * | 4/2005 | Takagi et al. | 249/139 |

* cited by examiner

*Primary Examiner*—Korie Chan
(74) *Attorney, Agent, or Firm*—Dinsmore & Shohl LLP

(57) ABSTRACT

A pre-cast panel forming system. The system includes one or more bulkheads to constrain the flow of uncured panel-forming material. The bulkhead is made up of an upstanding form and a base clip to secure the upstanding form to a panel-forming surface. The base clip is configured to promote ease of attachment to the panel-forming surface, even though the thickness dimension of the upstanding form is reduced relative to conventional forms. In accordance with 37 CFR 1.72(b), the purpose of this abstract is to enable the United States Patent and Trademark Office and the public generally to determine quickly from a cursory inspection the nature and gist of the technical disclosure. The abstract will not be used for interpreting the scope of the claims.

15 Claims, 6 Drawing Sheets

PANEL FORMING SYSTEM AND COMPONENTS

CROSS-REFERENCE TO RELATED APPLICATION

This application claims the benefit of U.S. Provisional Application Ser. No. 60/344,835, filed Dec. 21, 2001. This application is related to co-pending application 10/290,118, entitled PANEL FORMING SYSTEM AND COMPONENTS, filed Nov. 7, 2002.

BACKGROUND OF THE INVENTION

The present invention relates to forms and form supports used for creating cured pre-cast structures. More specifically, the present invention relates to configurations of pre-cast panel forming systems and various components of such systems.

Many residential and commercial construction methods involve the use pre-cast structures. Pre-cast panels, for example, are integral to the tilt-up construction process. In the tilt-up approach, concrete forms are arranged on a flat casting surface in the shape and dimension of the desired tilt-up panel, then filled with concrete. When the concrete cures, the panel and the form are separated and the panel is tilted up into a preferred, typically vertical, orientation, where it can be joined to structural frames or other panels. The present inventors have recognized a need for improvements in pre-cast panel forming systems and in various components of the panel forming systems. The improvements introduced by the present invention have applicability in the tilt-up construction process and in other pre-cast construction processes.

BRIEF SUMMARY OF THE INVENTION

This need is met by the present invention wherein improvements in pre-cast panel forming systems and in various components of the panel forming systems are introduced. In accordance with one embodiment of the present invention, a bulkhead is disclosed. The bulkhead includes an upstanding form and a base clip. The upstanding form is used to constrain the flow of uncured material that is introduced adjacent the longitudinal dimension of the upstanding form. The base clip comprises a plurality of attachment members, including a first configured to secure the base clip to the upstanding form, and a second configured to secure the base clip to the panel-forming surface. The second attachment portion includes a laterally-disposed arm such that it increases a base clip footprint formed on the panel-forming surface relative to that formed by a connection between the first attachment portion and the upstanding form.

Optionally, the base portion and upstanding form together define a unitary, monolithic structure. In addition, the second attachment portion can be substantially planar to more easily engage the panel-forming surface. In the present context, the term "substantially" is utilized represent the inherent degree of uncertainty that may be attributed to any quantitative comparison, value, measurement, or other representation. As such, it refers to an arrangement of elements or features that, while in theory would be expected to exhibit exact correspondence or behavior, may, in practice embody something slightly less than exact. The term also represents the degree by which a quantitative representation may vary from a stated reference without resulting in a change in the basic function of the subject matter at issue. The second attachment portion can further include an aperture in the laterally-disposed arm to accept a fastener therethrough. The first attachment portion may also include one or more projections configured to engage a complementary projection on the upstanding form. In one form, the first attachment portion is engaged with the upstanding form through a frictional fit between cooperating projections. More particularly, the projections engage one another through a plurality of interlocking prismatic members. Preferably, the angle subtended between the second attachment portion and the projection of the first attachment portion is substantially ninety degrees. Furthermore, the upstanding form includes a pair of substantially planar walls that are disposed substantially parallel to one another, thereby defining a thickness dimension from outer face to opposing outer face. Preferably (although not out of necessity), the thickness dimension is less than that of the smaller dimension of a conventional two-by-four piece of lumber. For example, the thickness dimension is less than about one and one-half inches, and can be narrower, for example less than about one inch, one-half inch, or other desired dimension. The upstanding form may further comprise one or more chamfers, wherein the chamfer may further comprise a knife-edge sealing projection configured for substantially discrete engagement with the panel-forming surface. The chamfers can include a projection similar to that that of the aforementioned first attachment portion such that upon securing the base clip to the upstanding form, the projection from the chamfer engages the first attachment portion, thus further securing the two. In one form, one chamfer is positioned on one side of the upstanding form while another chamfer is positioned on an opposing side of the upstanding form. Like the upstanding portion, the base clip can include one or more chamfers, which may be integrally formed with the base clip. The material making up the bulkhead can be any that facilitate simple, low-cost manufacture that combine desirable structural properties. In one form, the material can be extrudable, and more particularly, a plastic. By way of example, either or both of the upstanding form and base clip can be fabricated from the group consisting of plastic, metal, fibrous composites, or combinations thereof. In an additional option, the bulkhead is an extruded member, and more particularly, an extruded plastic member.

According to another embodiment of the present invention, a bulkhead is disclosed. The bulkhead includes an upstanding form and a base clip. The upstanding form is substantially similar to that of the previous embodiment, while the base clip includes a first attachment portion configured to engage the upstanding portion and a second attachment portion configured to engage the panel-forming surface. The second attachment portion includes a proximal end and a distal end. The first attachment portion is located at the proximal end of the second attachment portion and extends away from an attachment plane defined by the second attachment portion. The distal end of the second attachment portion is substantially free of structure extending away from the attachment plane. Optionally, the second attachment portion defines a substantially planar profile from the proximal end to the distal end. In addition, the second attachment portion defines a substantially planar base clip anchoring zone between the proximal end and the distal end. The base clip can also be configured such that substantially all structure extending away from the attachment plane is defined by the first attachment portion. More particularly, it can be configured such that substantially all of the first attachment portion extends from the proximal end of the second attachment portion.

According to another embodiment of the present invention, a bulkhead with an upstanding form and a base clip is disclosed. The upstanding portion is similar to that of the previous embodiments. The base clip includes an upper anchoring member, a lower anchoring member substantially aligned with the upper anchoring member along a fastening axis such that both the members are configured to accept a fastener therethrough, and a pedestal that couples the upper anchoring member to the lower anchoring member. Unlike the previous embodiments, the base clip is configured such that any fastener attached thereto is disposed not only below the upstanding form, but beneath it as well. In the present context, one item is considered to be "below" another when it occupies a lower vertical position relative to the other without regard to axial alignment along the vertical axis, while the same item would be considered "beneath" the other when it is not only below the other, but also directly underneath it such that they at least partially lie along the same vertical axis.

Optionally, the upper anchoring member is substantially planar. In one form, the upstanding form defines a monolithic structure, and may further include one or more chamfers disposed substantially adjacent the second end of the upstanding form. The upper anchoring member may further define an aperture therein for receiving the fastener. The pedestal can be configured to engage at least one complementary surface on the upstanding form. For example, the complementary surfaces engage one another through a plurality of interlocking prismatic members. In one form, the pedestal can include a pair of laterally-spaced projections that together are configured to form a friction fit with the upstanding form. More particularly, a plurality of interlocking prismatic members can be used to promote the friction fit. Preferably, the base clip is free of projections above the upper anchoring member. In another option, the lower anchoring member defines a flange, which may additionally extend laterally beyond the upstanding form, thus allowing the flange and the pedestal to form a detent receiving chamber between them. In still another option, one end of the upstanding form terminates in at least one projecting detent such that the detent can fit within the detent receiving chamber upon connection of the upstanding form to the base clip. A fastener can further be included to extend from the upper anchoring member through the lower anchoring member.

According to another embodiment of the present invention, a panel forming system is disclosed. The system includes a plurality of bulkheads, each similar to that of one or more of the previous embodiments, and a plurality of connectors. The plurality of connectors may include at least one of a corner connector, in-line joint connector and a T-joint connector, each of which can be disposed between adjacent end portions of respective bulkheads to provide connectivity between them. The connectors and the bulkheads can be arranged to produce a panel of desired shape and dimension, including a substantially rectangular panel form. Through the use of multiple bulkheads and connectors, multiple-cavity panels can be formed. In the case of substantially rectangular panels, the forms include at least four bulkheads and at least four corner connectors. The pair of substantially rectangular panel forms can further include a plurality of in-line joint connectors to make extended-size panels.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1A:
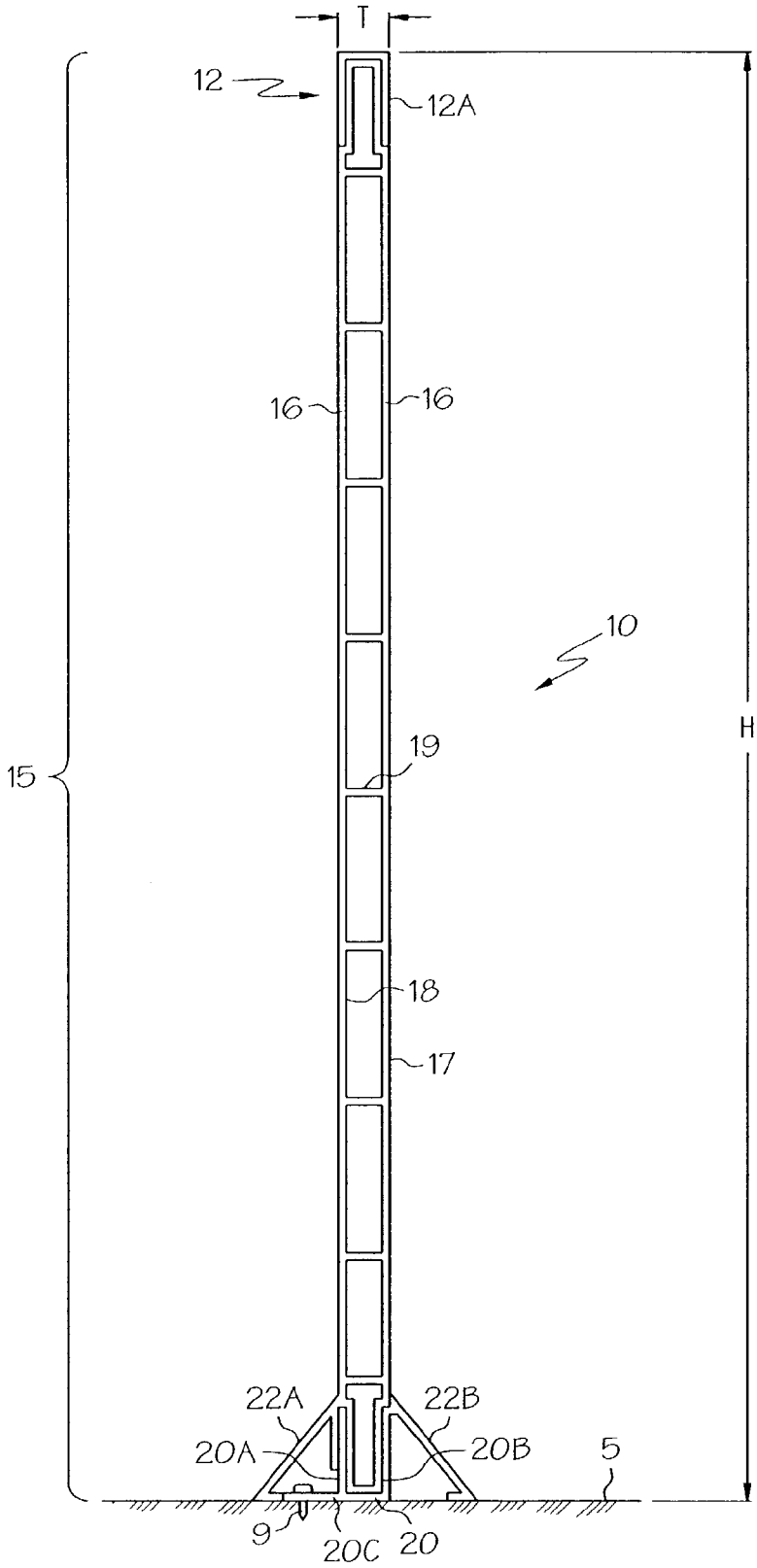
FIG. 1A is a sectional view of one bulkhead of the panel-forming system of the present invention, showing it being secured to a panel-forming surface.
Figure 1B:
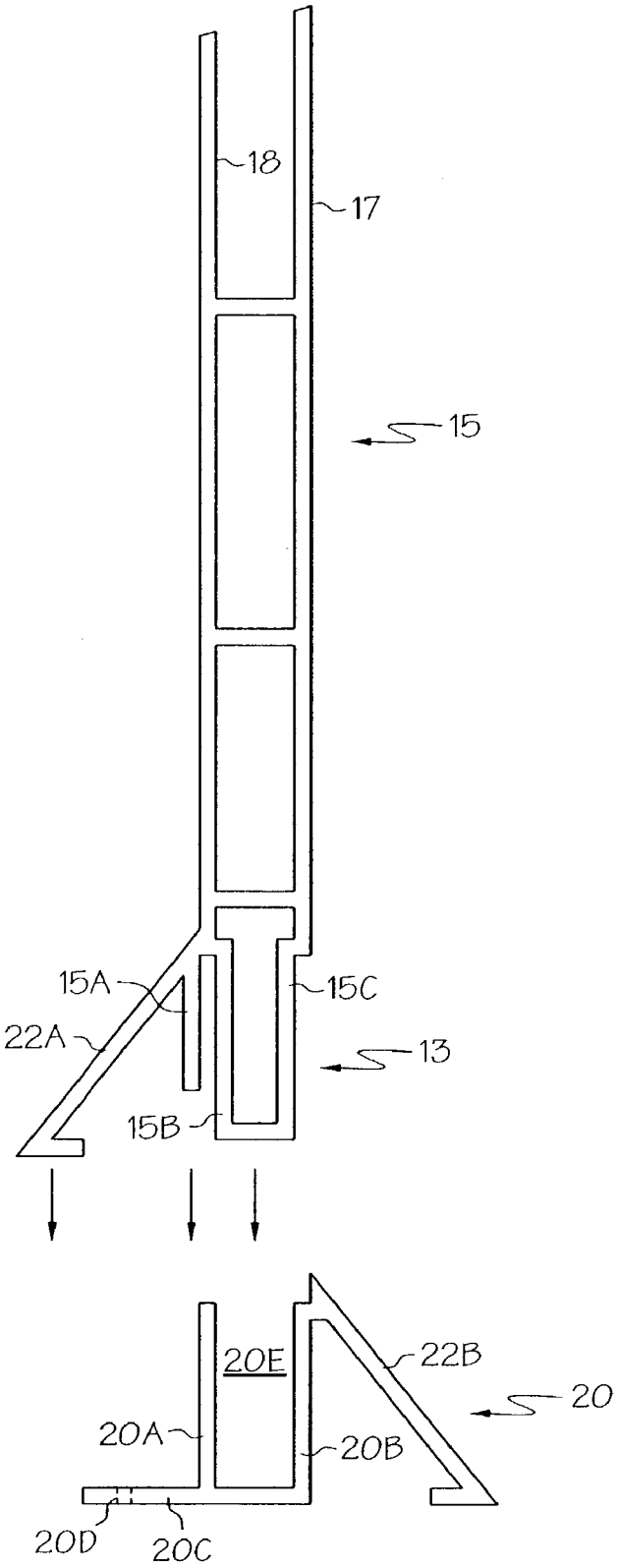
FIG. 1B shows the bulkhead of FIG. 1A with the components thereof in their separated state.
Figure 2:
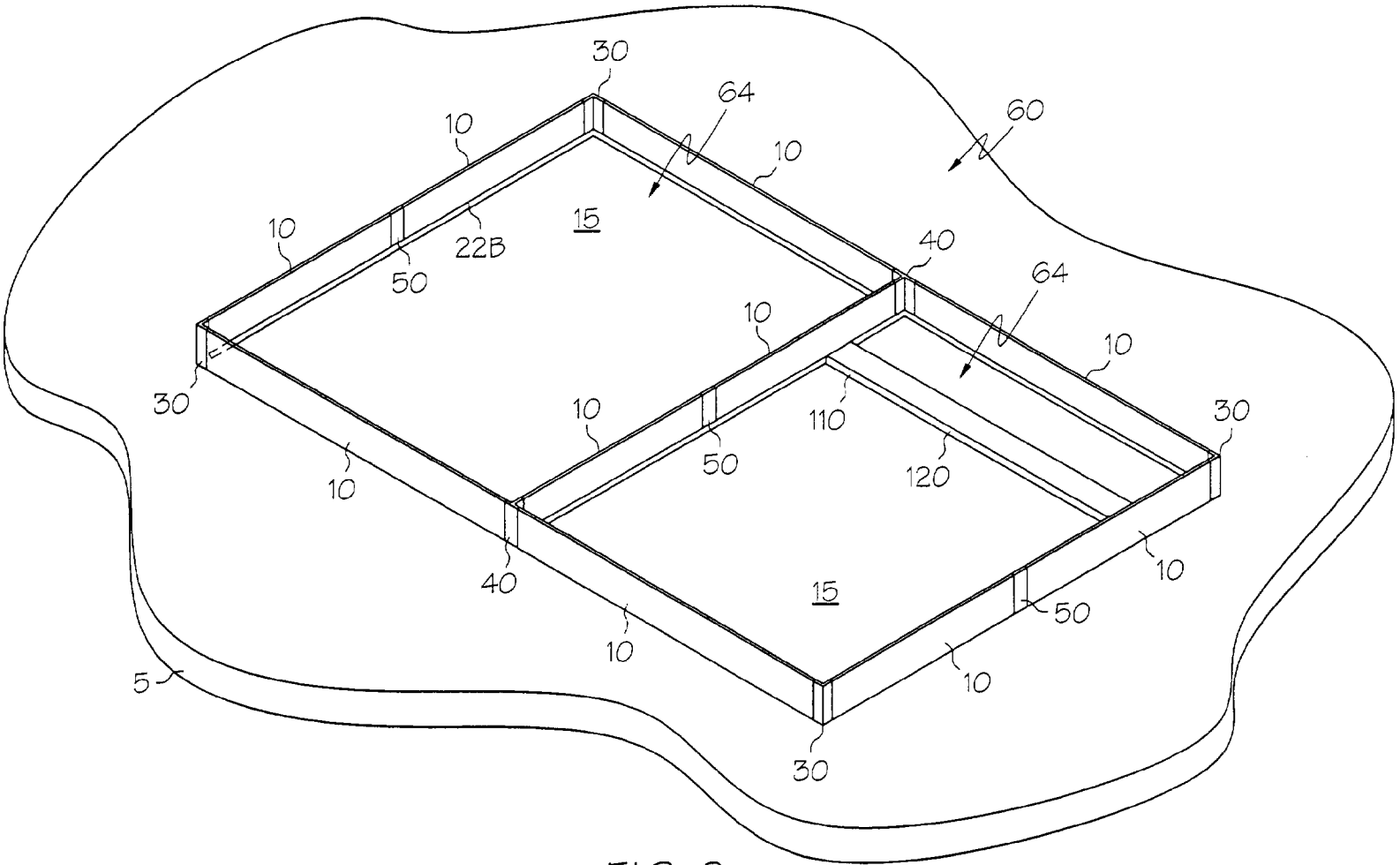
FIG. 2 is a schematic illustration of a panel forming system according to the present invention.

Referring first to FIGS. 1A, 1B and 2, a single bulkhead 10 and a panel-forming system 60 made from a plurality of bulkheads 10, both according to the present invention, are shown. By contrast to traditional wooden forms, which may be dimensioned as two-by-four, two-by-six or two-by-twelve (or similar related size, depending on the application) pieces of lumber that are placed edgewise into channels of a separate base, the thickness dimension T of the present bulkhead 10 may be significantly smaller. This reduced dimension, while still possessive of the necessary strength and rigidity, leads to considerably lighter components that are both more portable and storable than that of the prior art. Each bulkhead 10 may comprise a monolithic upstanding form 15 and base clip 20 that together define the bulkhead 10. For the purposes of defining and describing the present invention, it is noted that a monolithic structure is one of unitary construction, such that it constitutes a single unit devoid of any disconnecting joints or seams. Such structures can be produced through a variety of known fabrication techniques, such as casting, molding or extrusion, the last of which is frequently used where the finished product has a constant cross-section along its longitudinal dimension. In operation, the upstanding form 15 is placed edgewise into base clip 20, the latter being secured to a panel-forming surface 5. When the desired panel shape is created (typically with one or more of the bulkheads 10) the material that will make up the panel is introduced, in uncured form, into one or more panel cavities 62, 64 (shown with particularity in FIG. 2), flowing until it encounters bulkhead 10, which then substantially constrains the further flow of the material to that along the longitudinal dimension of the bulkhead 10 until the shape defined by the cavities 62, 64 is filled, after which the material is allowed to harden.

The upstanding form 15 is defined by a first end 12 and a second end 13. The upstanding form 15 comprises a pair of walls 16 defining a height dimension H and are spaced from each other to define a thickness dimension T. Each of the upstanding walls 16 comprises an exterior face 17 and an interior face 18, the latter between which one or more cross-sectional support members 19 may extend. At least one of the cross-sectional support members 19 may be located at a point along the height dimension of the upstanding form 15 so as to provide substantial resistance to reduction of the width dimension under pressure applied to one of the exterior faces 17. In this manner, the integrity of the panel shape defined by each panel cavity 62, 64 of the panel forming system 60 may be maintained under the significant pressure created by uncured panel-forming material present therein. The cross sectional support members 19 may simply comprise a single linear extension that is substantially perpendicular to the pair of upstanding walls 16, or as more complex structures arranged in perpendicular or non-perpendicular configurations. For example, as shown in the figure, the bulkhead 10 can employ a plurality of these types of cross sectional support members 19 spaced along the height dimension H of walls 16, including at or near one or both of the opposing ends. The first end 12 may comprise an end cap 12A or a locking channel (not shown) to permit repeatable engagement and disengagement between adjacent upstanding forms 15, or between the upstanding form 15 and connectors or braces (to be discussed later). Details of such features can be found in co-pending application 10/290,118, entitled PANEL FORMING SYSTEM AND COMPONENTS, filed Nov. 7, 2002, assigned to the present assignee and incorporated herein by reference.

The base clip 20 is used to secure the upstanding form 15 to the panel-forming surface 5. To effect this, the base clip 20 can accommodate any number of suitable securing means, including adhesives, adhesive tapes, and mechanical fasteners, such as nails or screws. As shown with particularity in FIG. 1B, the base clip 20, being removable from bulkhead 10, is not part of the aforementioned monolithic structure defined by the upstanding form 15, although it is not outside the scope of the present invention for the base clip 20 to be integrated into the monolithic structure. The base clip 20 includes a first attachment portion (made up of projections 20A and 20B) and a second attachment portion 20C that extends laterally such that an upper surface of the second attachment portion 20C can be accessed from above without either of projections 20A and 20B or any other projection (not shown) on base clip 20 getting in the installer's way. Since the space between projections 20A and 20B defines a relatively deep, narrow channel 20E that is generally not conducive for attaching a conventional fastener 9, the second attachment portion 20C (in the form of an arm-like extension), with its extended and substantially planar lower surface, allows easy access for an installer to secure the base clip 20 to the panel-forming surface 5. This is advantageous in that it allows an installer to align and secure the base clip 20 to the panel-forming surface 5 (such as through fastener 9, both of which are shown in FIG. 1A) prior to the attachment of the second end 13 of upstanding form 15 to the base clip 20 without interference from projections that would otherwise hamper the ability to place and subsequently secure the fastener 9. The inclusion of the laterally-disposed second attachment portion 20C also increases the footprint of base clip 20, making it more stable prior to being secured to the panel-forming surface 5, thereby allowing the installer additional flexibility and "fine-tuning" in arranging various bulkheads 10. This extra footprint is especially helpful for thin bulkheads that would otherwise be more susceptible to tipping prior to being secured to the panel-forming surface 5. Second attachment portion 20C of base clip 20 can also have an aperture 20D placed through its generally planar surface to facilitate the placement and subsequent anchoring of fastener 9. The first attachment portion engages complementary projections 15A, 15B and 15C that extend downwardly from the second end 13 of upstanding form 15. Although not shown, it will be appreciated by those skilled in the art that base clip 20 may alternatively be attached to the panel-forming surface 5 with an adhesive instead of a fastener 9.

Figure 3:
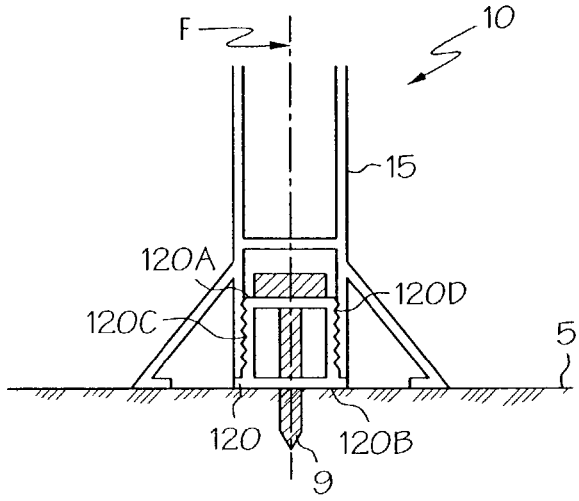
FIG. 3 is an alternate configuration of the bulkhead of FIG. 1.
Figure 4A:
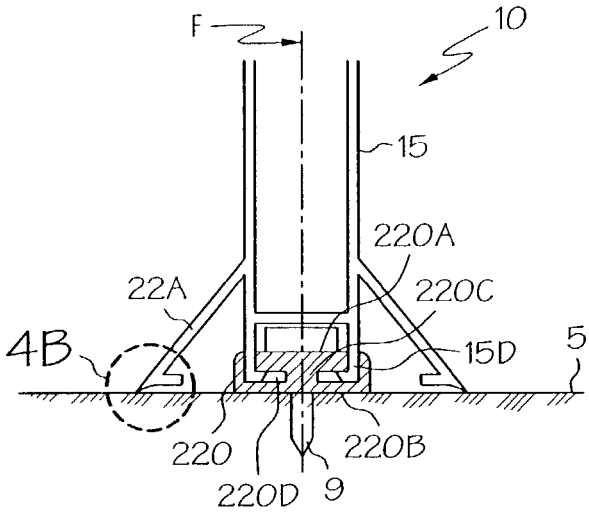
FIG. 4A is an alternate configuration of the bulkhead of FIG. 1.

Various configurations for the cooperative engagement between the upstanding form 15 and the base clip 20 are possible. Referring with particularity to FIGS. 3 and 4A, an alternative configuration for the connection between the bulkhead 10 and the panel-forming surface 5 is shown. Unlike the previous configuration, where the portion of the base clip 20 that receives the fastener 9 is laterally offset relative to the connection between the upstanding form 15 and the base clip 20 (as shown in FIGS. 1A and 1B), the components of the present base clips 120, 220 are in substantial alignment with one another along a fastening axis F. Thus, in the orientation shown, an upper anchoring member 120A, 220A represents the vertically uppermost portion of the base clip 120, 220, and forms a generally planar surface through which a fastener 9 can be placed. A lower anchoring member 120B, 220B is configured to rest upon panel-forming surface 5, and is substantially aligned with upper anchoring member 120A, 220A along fastening axis F such that fastener 9 can engage with surfaces of both members to secure the base clip 120, 220 to panel-forming surface 5. A pedestal 120C, 220C connects the upper anchoring members 120A, 220A to lower anchoring members 120B, 220B, and also defines a projection that can be used to engage complementary surfaces on upstanding form 15. The projection formed by pedestal 120C, 220C preferably achieves engagement with upstanding form 15 through a frictional fit. Particular forms of frictional fit are emphasized in the two figures. FIG. 3 represents one form, where numerous interlocking prismatic retention members 120D interact with complementary surfaces on the downward-projecting lower surfaces of upstanding form 15. The prismatic retention members 120D could be triangular, saw-tooth or trapezoidal in shape, for example. In one embodiment, the relationship between the prismatic retention members 120D and the surface of the second end 13 of upstanding form 15 is such that a permanent lock can be formed, while in another, the relationship can be readily engaged and disengaged. In the present context, a locking arrangement is considered "permanent" where the connection between two members is such that they cannot be separated without severely curtailing or disabling their subsequent connective properties. FIG. 4A includes a detent receiving chamber 220D formed by T-shaped pedestal 220C that can grab and hold a pair of detents 15D extending from the second end 13 of the upstanding form 15. As with the prismatic retention members 120D of FIG. 3, the engagement between the detent receiving chamber 220D and detents 15DA of FIG. 4A can be configured to be permanent or repeatably engageable. By virtue of having there be no projections extending upward from the base clip 120, 220 of the embodiments of FIGS. 3 and 4A above the upper anchoring member 120A, 220A, the attachment of the base clip 120, 220 to a panel-forming surface 5 is made easier, as an installer can grasp and place fastener on the upper anchoring surface 120A, 220A, even in situations where the lateral thickness dimension T of the upstanding form 15 is relatively narrow compared to a conventional two-by-four or related form.

Referring again to FIG. 2, a plurality of bulkheads 10 are joined by connectors 30, 40, 50 to form a panel-forming system 60. Typically, the panel-forming system 60 is placed on a substantially smooth, planar surface, such as panel-forming surface 5. A panel-forming material may be poured or otherwise introduced into respective cavities 62, 64 of the panel forming system 60 and subsequently cured to form monolithic panels (not shown). The cured panels may be removed from the cavities 62, 64 and used in a variety of applications including, but not limited to, tilt-up and other pre-cast construction applications. A rustication 120 may be utilized to create a particular profile or pattern in the surface of the panel. The panel forming system 60 and its various components may be formed from any of variety of suitable materials including, but not limited to, plastics, metals, resins, fibrous composites, and combinations thereof. These materials may be partially or fully synthetic, and in one form, can be an extrudable material such as an extrudable plastic. Indeed, certain embodiments of the present invention relate directly to the bulkhead as an extruded member. As will be appreciated by those familiar with the art of extrusion, an extruded member defines a substantially uniform extruded cross section that extends along substantially the entire length of the member. Insignificant variations in the uniformity of the cross section due to fabrication process errors or post fabrication process steps are contemplated. For example, holes may be drilled in an extruded member in specific locations after the member is extruded. Similarly, cuts or cutouts may be formed in the extruded member after it is extruded.

Figure 4B:
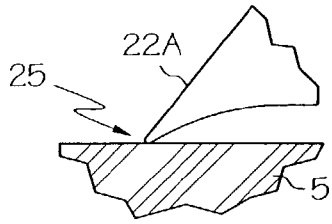
FIG. 4B is an alternate configuration of the lower projecting edge of the chamfer of FIG. 4A.

Referring again to FIGS. 1A, 1B, 3 and 4A, the bulkhead 10 may further include chamfers 22A, 22B to form beveled surfaces on the edges of the panels. The chamfers may be formed integral with the upstanding form 15, the base clip 20, or both. For example, as shown with clarity in FIG. 1B, the upstanding form 15 can include an integrally formed chamfer 22A extending from one of the walls 16 at or near second end 13, while the base clip 20 include an integrally formed chamfer 22B extending from one of the projections 20B of the first attachment portion. It will be appreciated by those skilled in the art that the configuration depicted in the figure is notional, and that it is within the scope of the present invention to have the chamfers mounted in other ways, such as having both chamfers 22A, 22B formed with the upstanding form 15, an example of which is depicted in FIGS. 3 and 4A. Moreover, the surface of the chamfer that engages the panel-forming surface 5 need not be planar; referring with particularity to FIG. 4B, an alternate configuration of the end of chamfer 22A that engages the panel-forming surface 5 is shown. In this configuration, rather than forming a substantially planar lower surface, the chamfer 22A forms a more discrete, knife-edge contact at end 25. This shape, disclosed in co-pending application Ser. No. 09/918,965, entitled TILT-UP CONSTRUCTION CHAMFERS, filed Jul. 31, 2001, assigned to the present assignee and incorporated herein by reference, helps to form a seal between the chamfer 22A and the panel-forming surface 5, thereby reducing or eliminating the leakage of uncured panel material into the space between the bulkhead and the surface 5. Although the knife-edge seal 25 is notionally shown on chamfer 22A, it will be appreciated that such an edge is equally applicable to any of the other chamfers shown or described herein.

Figure 6:
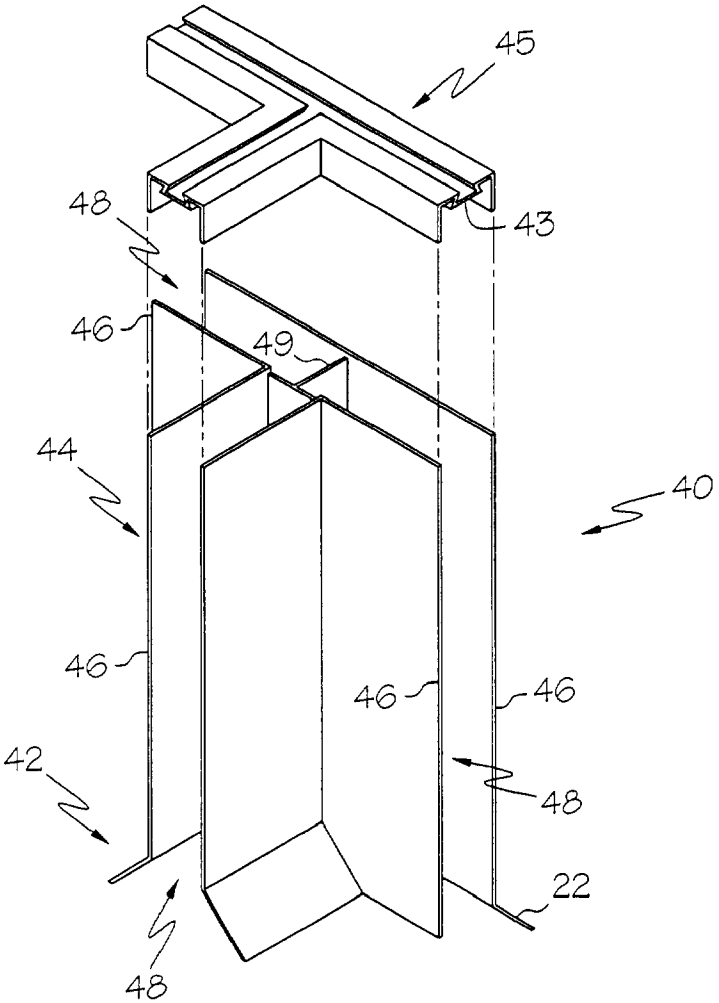
FIG. 6 is a perspective view of a T-joint connector according to the present invention.
Figure 5:
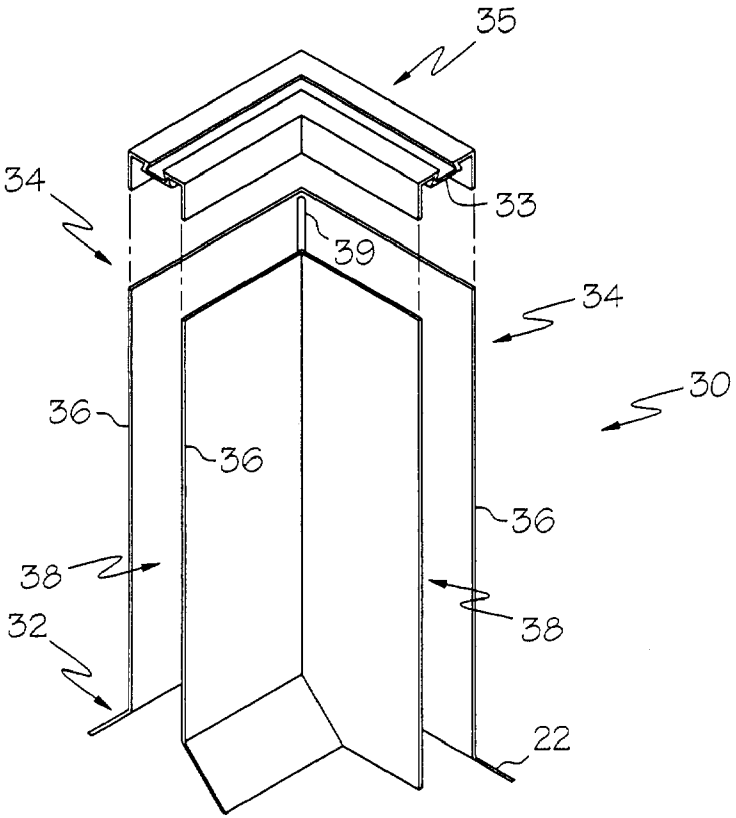
FIG. 5 is a perspective view of a corner connector according to the present invention.
Figure 7:
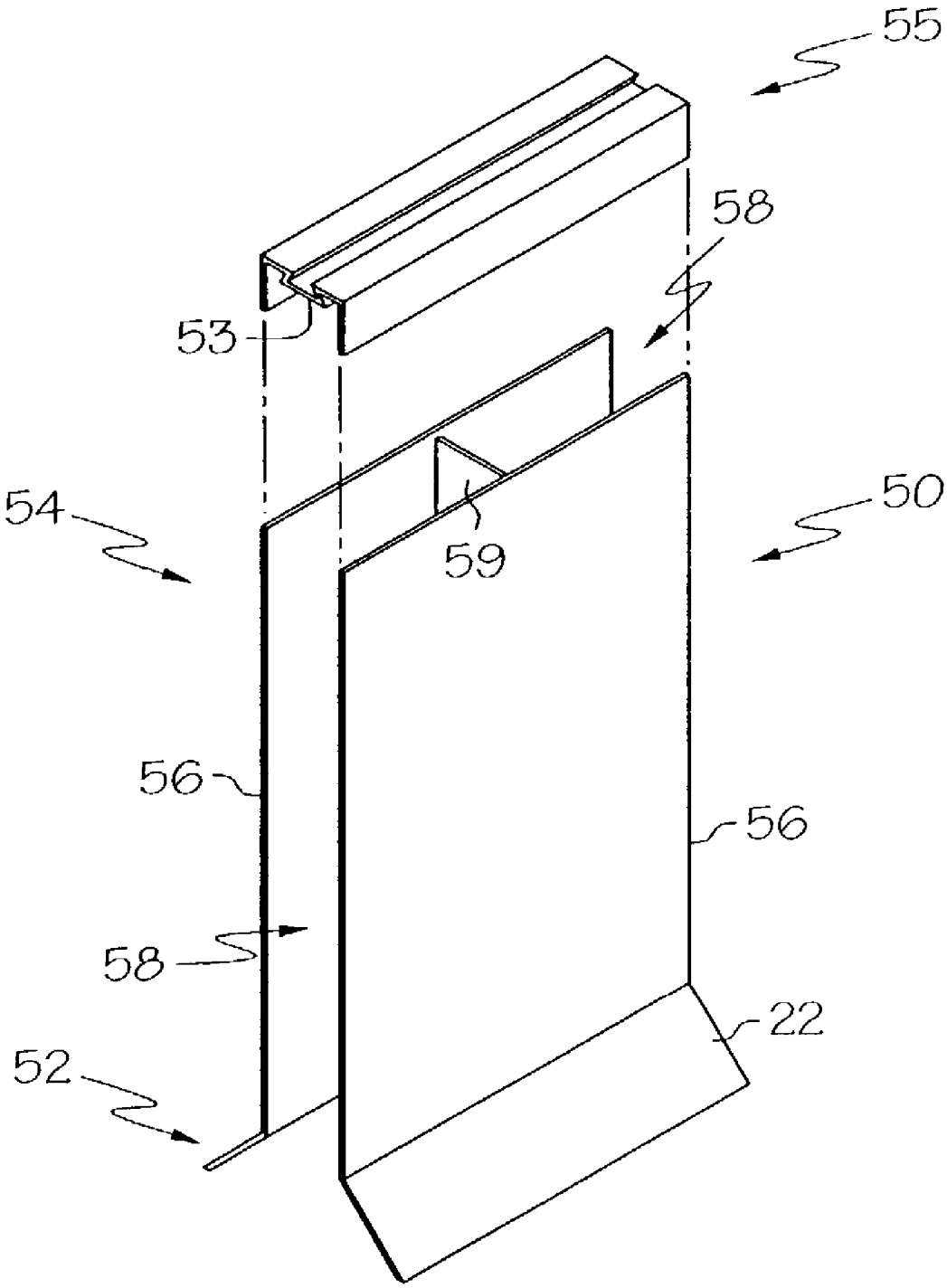
FIG. 7 is a perspective view of an in-line connector according to the present invention.

Referring now to FIGS. 5 through 7, the bulkhead connectors 30, 40, 50 are shown. Each connector 30, 40, 50 comprises a base portion 32, 42, 52 and an upstanding portion 34, 44, 54. As with the bulkhead 10 (shown previously), the connectors 30, 40, 50 can be defined by a monolithic structure. The upstanding portions 34, 44, 54 comprise at least one pair of walls 36, 46, 56. Each connector defines at least one bulkhead receiving area 38, 48, 58 bounded in part by the pair of walls 36, 46, 56 and the base portion 32, 42, 52. Each of the bulkhead receiving areas 38, 48, 58 defines dimensions sufficient to accommodate an end portion of bulkhead 10 securely therein. The extent to which the connectors 30, 40, 50 are secured to the bulkheads 10 is preferably sufficient to serve as a barrier to the flow of uncured panel-forming material between the connectors 30, 40, 50 and the bulkhead 10. The connectors 30, 40, 50 are characterized by a rigidity sufficient to resist significant deformation and breakage under cross-longitudinal panel forming pressure exerted upon a bulkhead under the load of poured panel-forming material. In a manner analogous to the upstanding form 15 of FIG. 1A, the connectors 30, 40, 50 may further comprise at least one cross-sectional support member 39, 49, 59 extending between walls 36, 46, 56, while the base portion 32, 42, 52 may comprise chamfers 22. The connectors 30, 40, 50 may further comprise connector caps 35, 45, 55 sized and configured to complement the size and configuration of the upstanding portions 34, 44, 54 of the connectors 30, 40, 50. The connector caps 35, 45, 55 may be configured to form a sealed interface with the upstanding portions 34, 44, 54 and may comprise locking projections 33, 43, 53 configured to engage an end portion of a bulkhead secured within the bulkhead receiving areas 38, 48, 58. It will be appreciated that the connector configuration shown is exemplary only, as other connectors of suitable design could also be used.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A bulkhead comprising:

an upstanding form configured to at least partially constrain the flow of uncured casting material introduced adjacent said upstanding form; and a base clip configured to couple said upstanding form to a panel-forming surface, said base clip comprising:

an upper anchoring member;

a lower anchoring member substantially aligned with said upper anchoring member along a fastening axis such that both said members accept a fastener therethrough along said fastening axis; and a pedestal configured to displace said upper anchoring member from said lower anchoring member along said fastening axis, wherein at least one projection extends substantially transversely to said fastening axis from a surface of at least one of said pedestal and said form and at least one complementary recess formed on a surface of at least one of said pedestal and said form such that together said at least one recess and said at least one projection define a locking arrangement.

2. A bulkhead according to claim 1, wherein said upper anchoring member is substantially planar.

3. A bulkhead according to claim 1, wherein said upstanding form defines a monolithic structure.

4. A bulkhead according to claim 3, further comprising at least one chamfer disposed substantially adjacent said upstanding form.

5. A bulkhead according to claim 1, wherein said upper anchoring member defines an aperture disposed therein for receiving said fastener.

6. A bulkhead according to claim 1, wherein said locking arrangement is permanent.

7. A bulkhead according to claim 1, wherein said at least one projection and said at least one recess comprise a plurality of interlocking prismatic members.

8. A bulkhead according to claim 1, wherein said pedestal comprises a pair of laterally-spaced projections that together are configured to form a friction fit with said upstanding form.

9. A bulkhead according to claim 8, wherein said friction fit is effected through a plurality of interlocking prismatic members.

10. A bulkhead according to claim 1, wherein said base clip defines a substantially planar upper surface.

11. A bulkhead according to claim 1, wherein said lower anchoring member defines a flange.

12. A bulkhead according to claim 11, wherein said flange extends laterally beyond said surface of said upstanding form.

13. A bulkhead according to claim 12, wherein said flange and said pedestal form a detent receiving chamber therebetween.

14. A bulkhead according to claim 13, where said upstanding form terminates in at least one projecting detent, said detent configured to fit within said detent receiving chamber upon connection of said upstanding form to said base clip.

15. A bulkhead according to claim 1, further comprising a fastener configured to extend from said upper anchoring member through said lower anchoring member.

* * * * *